US006431835B1

(12) United States Patent
Kolodziej et al.

(10) Patent No.: US 6,431,835 B1
(45) Date of Patent: Aug. 13, 2002

(54) FAN BLADE COMPLIANT SHIM

(75) Inventors: Michael Kolodziej, Phoenix; Bruce D. Wilson, Chandler, both of AZ (US)

(73) Assignee: Honeywell International, Inc., Morristown, NJ (US)

( * ) Notice: Subject to any disclaimer, the term of this patent is extended or adjusted under 35 U.S.C. 154(b) by 0 days.

(21) Appl. No.: 09/690,216

(22) Filed: Oct. 17, 2000

(51) Int. Cl.[7] ..... F01D 5/30
(52) U.S. Cl. ..... 416/219 R; 416/248
(58) Field of Search ..... 416/219 R, 204 A, 416/241 R, 248

(56) References Cited

U.S. PATENT DOCUMENTS

| | | | | | |
|---|---|---|---|---|---|
| 2,686,656 | A | | 8/1954 | Abild | |
| 3,317,988 | A | | 5/1967 | Endres | |
| 4,169,694 | A | | 10/1979 | Sanday | |
| 4,417,854 | A | | 11/1983 | Cain et al. | |
| 4,820,126 | A | | 4/1989 | Gavilan | |
| 4,980,241 | A | | 12/1990 | Hoffmueller et al. | |
| 5,087,174 | A | | 2/1992 | Shannon et al. | |
| 5,137,420 | A | * | 8/1992 | Sigworth et al. | 415/170.1 |
| 5,139,389 | A | * | 8/1992 | Eng et al. | 416/248 |
| 5,160,243 | A | | 11/1992 | Herzner et al. | |
| 5,240,375 | A | | 8/1993 | Wayte | |
| 5,312,696 | A | | 5/1994 | Beers et al. | |
| 5,368,444 | A | | 11/1994 | Anderson | |
| 5,558,500 | A | | 9/1996 | Elliott et al. | |
| 5,791,877 | A | | 8/1998 | Stenneler | |
| 6,132,175 | A | * | 10/2000 | Cai et al. | 416/220 R |
| 6,202,273 | B1 | * | 3/2001 | Watts | 29/243.56 |

FOREIGN PATENT DOCUMENTS

| | | |
|---|---|---|
| EP | 0 678 590 A1 | 4/1994 |
| EP | 0 669 403 A2 | 11/1994 |
| GB | 1 355 554 | 6/1971 |
| WO | PCT/US 01/32031 | 3/2002 |

* cited by examiner

*Primary Examiner*—Edward K. Look
*Assistant Examiner*—Ninh Nguyen
(74) *Attorney, Agent, or Firm*—Robert Desmond, Esq.

(57) ABSTRACT

A compliant shim for use between the root of a gas turbine fan blade and a dovetail groove in a gas turbine rotor disk to reduce fretting therebetween. The compliant shim has first and second slots for engaging tabs extending from the fan blade root. The slots and tabs cooperate to hold the shim during engine operation. An oxidation layer covers the compliant shim.

22 Claims, 3 Drawing Sheets

FAN BLADE COMPLIANT SHIM

TECHNICAL FIELD

This invention relates generally to gas turbine engines and in particular, to a compliant shim used between the dovetail root of a fan or compressor blade and the corresponding dovetail groove in a fan or compressor disk.

BACKGROUND OF THE INVENTION

As discussed in the Herzner et al, U.S. Pat. No. 5,160,243, when two pieces of material rub or slide against each other in a repetitive manner, the resulting frictional forces may damage the materials through the generation of heat or through a variety of fatigue processes generally termed fretting. Some materials systems, such as titanium contacting titanium, are particularly susceptible to such damage. When two pieces of titanium are rubbed against each other with an applied normal force, the pieces can exhibit a type of surface damage called galling after as little as a hundred cycles. The galling increases with the number of cycles and can eventually lead to failure of either or both pieces by fatigue.

The use of titanium parts that can potentially rub against each other occurs in several aerospace applications. Titanium alloys are used in aircraft and aircraft engines because of their good strength, low density and favorable environmental properties at low and moderate temperatures. If a particular design requires titanium pieces to rub against each other, the type of fatigue damage just outlined may occur.

In one type of aircraft engine design, a titanium compressor disk, also referred to as a rotor, or fan disk has an array of dovetail slots in its outer periphery. The dovetail base of a titanium compressor blade or fan blade fits into each dovetail slot of the disk. When the disk is at rest, the dovetail of the blade is retained within the slot. When the engine is operating, centrifugal force induces the blade to move radially outward. The sides of the blade dovetail slide against the sloping sides of the dovetail slot of the disk, producing relative motion between the blade and the rotor disk.

This sliding movement occurs between the disk and blade titanium pieces during transient operating conditions such as engine startup, power-up (takeoff), power-down and shutdown. With repeated cycles of operation, the sliding movement can affect surface topography and lead to a reduction in fatigue capability of the mating titanium pieces. During such operating conditions, normal and sliding forces exerted on the rotor in the vicinity of the dovetail slot can lead to galling, followed by the initiation and propagation of fatigue cracks in the disk. It is difficult to predict crack initiation or extent of damage as the number of engine cycles increase. Engine operators, such as the airlines, must therefore inspect the insides of the rotor dovetail slots frequently, which is a highly laborious process.

Various techniques have been tried to avoid or reduce the damage produced by the frictional movement between the titanium blade dovetail and the dovetail slot of the titanium rotor disk. One technique is to coat the contacting regions of the titanium pieces with a metallic alloy to protect the titanium parts from galling. The sliding contact between the two coated contacting regions is lubricated with a solid dry film lubricant containing primarily molybdenum disulfide, to further reduce friction.

While this approach can be effective in reducing the incidence of fretting or fatigue damage in rotor/blade pieces, the service life of the coating has been shown to vary considerably. Furthermore, the process for applying the metallic alloy to the disk and the blade pieces has been shown to be capable of reducing the fatigue capability of the coated pieces. There exists a continuing need for an improved approach to reducing such damage and assure component integrity. Such an approach would desirably avoid a major redesign of the rotor and blades, which have been optimized over a period of years, while increasing the life of the titanium components and the time between required inspections. The present invention fulfills this need, and further provides related advantages.

U.S. Pat. Nos. 5,160,243 and 5,240,375 disclose a variety of single layer and multi-layer shims designed for mounting between the root of a titanium blade and its corresponding groove in a titanium rotor. The simplest of these shims is a U-shaped shim designed to be slide over the root of the fan blade, (see FIG. 3 of the '243 patent). A disadvantage to this type of shim are that it has a tendency to come lose during engine operation. Also, it does not entirely eliminate the fretting between the groove and the fan blade root.

Accordingly, there is a need an improved compliant shim for eliminating fretting between titanium components and a mechanism for holding such a shim in place during engine operation.

SUMMARY OF THE INVENTION

An object of the present invention is to provide an improved compliant shim for eliminating fretting between titanium components and a mechanism for holding such a shim in place during engine operation.

The present invention meets this objective by providing compliant shim for use between the root of a gas turbine fan blade and a dovetail groove in a gas turbine rotor disk to reduce fretting therebetween. The compliant shim has first and second slots for engaging tabs extending from the fan blade root. The slots and tabs cooperate to hold the shim during engine operation. An oxidation layer covers the compliant shim and reduces fretting between the blade and the compliant layer.

These and other objects, features and advantages of the present invention are specifically set forth in or will become apparent from the following detailed description of a preferred embodiment of the invention when read in conjunction with the accompanying drawings.

DESCRIPTION OF THE PREFERRED EMBODIMENT

Figure 1:
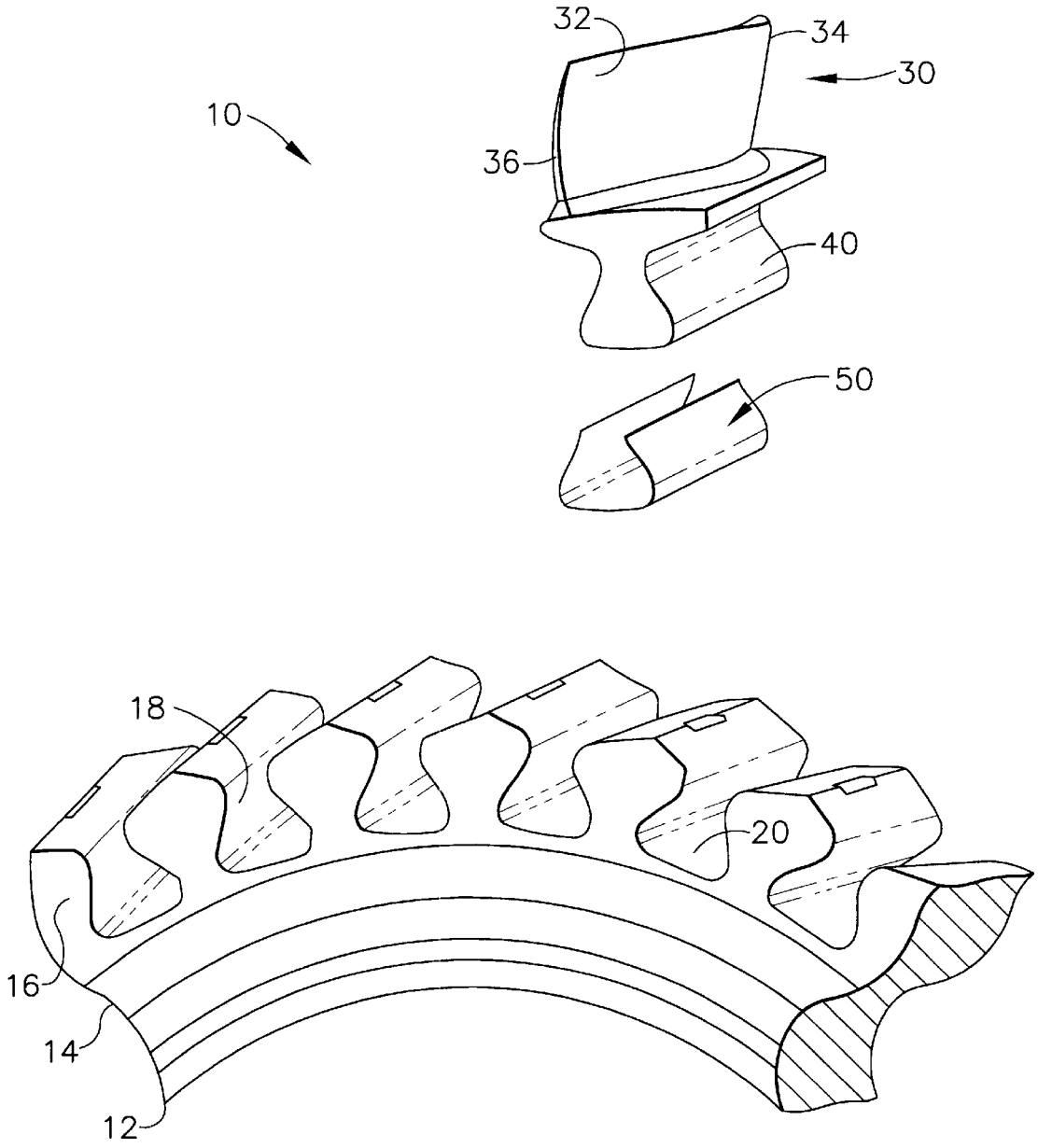
FIG. 1 is an exploded view of a rotor assembly contemplated by the present invention.

Referring to FIG. 1, a fan assembly is generally denoted by the reference numeral 10. The assembly 10 includes a disk 12 having an annular web portion 14 and an outer periphery 16 having a plurality of dovetailed configured grooves 18 with radially outward facing base surfaces 20. The grooves 18 extend through the periphery 16 at an angle between the disk's 12 axial and tangential axes referred to as disk slot angle.

Fan blades 30 are carried upon the outer periphery 16. Each blade 30 includes a radially upstanding airfoil portion 32 that extends from a leading edge 34 to a trailing edge 36. Each blade 30 also has a root portion 40 which is dovetail shaped to be received by one of the grooves 18. At its leading and trailing edges the root portion 40 has tabs 42, 44 that extend radially inward toward the base surface 20 to define a gap between the base surface 20 and an inner surface 41 of the root portion 40. A tab 46 adjacent the tab 44 extends further inward and abuts an axially facing surface of the outer periphery 16. The tab 46 is commonly referred to as a beaver tooth. In the preferred embodiment, the disk 12 and fan blade 30 are made from titanium or titanium alloys.

Figure 2:
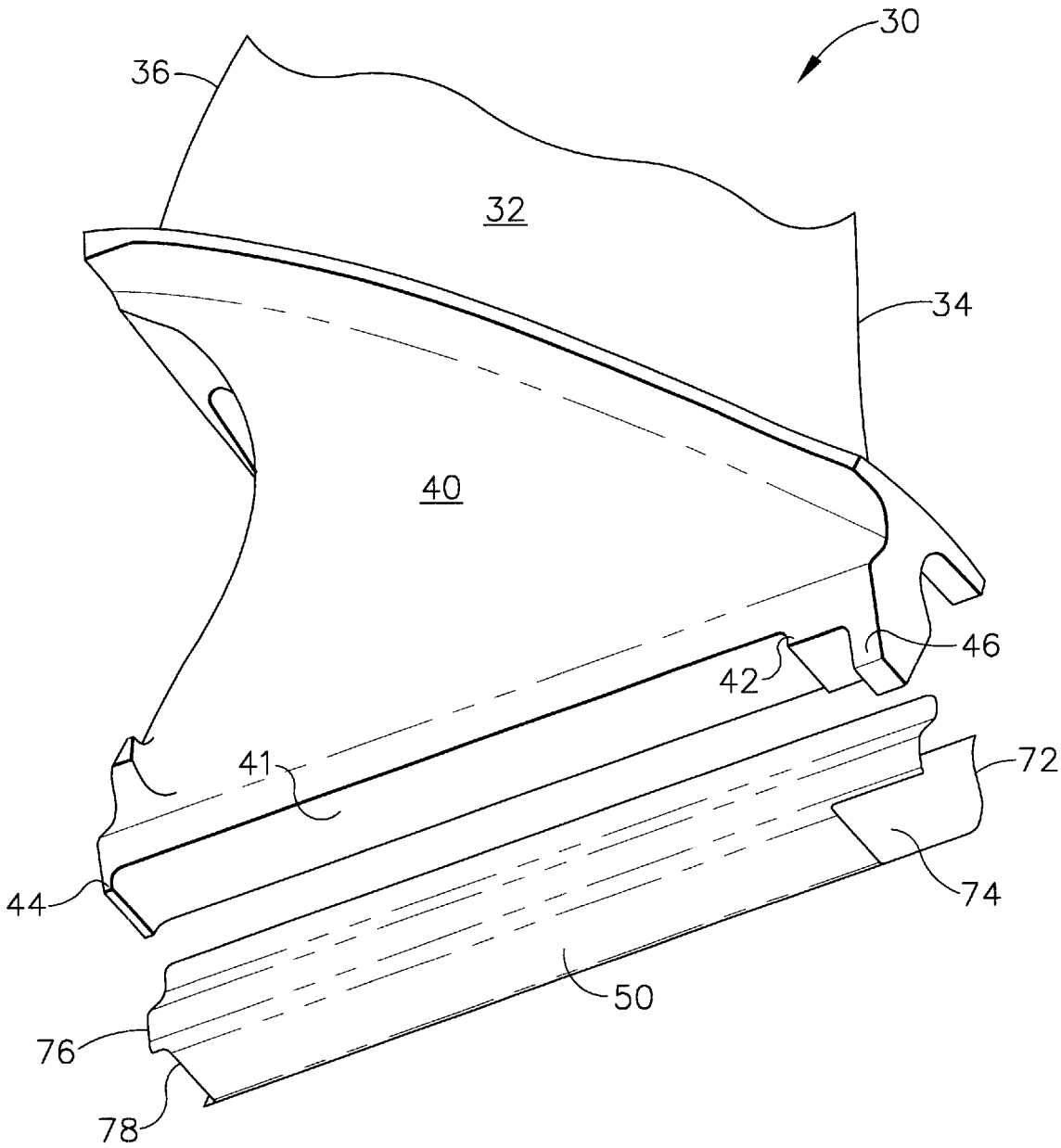
FIG. 2 is a perspective view of a blade assembly having the compliant sleeve contemplated by the present invention.
Figure 3:
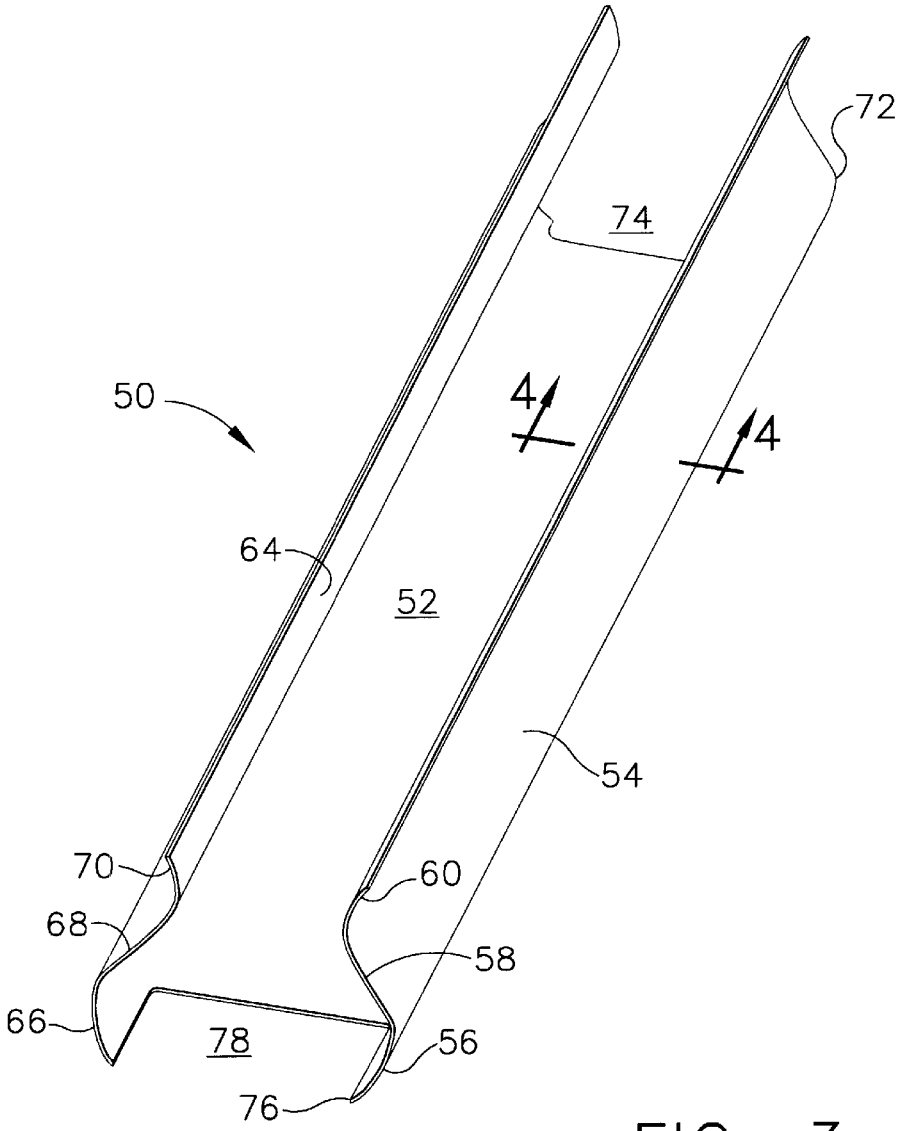
FIG. 3 is a perspective of the compliant sleeve contemplated by the present invention.
Figure 4:
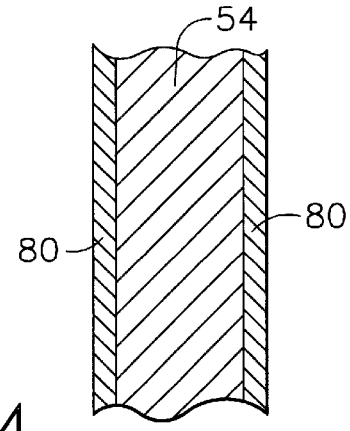
FIG. 4 is a cross-sectional view taken along line 4—4 of FIG. 3.

Referring to FIGS. 2 and 3, the shim 50 is a thin, layered sheet formed for mounting in the gap between the base surface 20 and the inner surface 41. The shim 50 has a flat base 52 and two spaced apart walls 54, 64 that extend outward from the base 52. Each of the walls 54, 64 is curvilinear and has a first portion 56, 66 that curves away from each other, a second portion 58,68 that curves toward each other and a third portion 60, 70 that curves away from each other. The shim 40 extends from a first end 72 to a second end 76. The end 72 having a slot 74 for receiving tab 42 and the end 76 having a slot 78 for receiving tab 44. The blade 30 is mounted to the disk 12 by sliding a shim onto the root 40 and then inserting the shimmed blade into a dovetail slot in a manner familiar to those skilled in the art. Referring to FIG. 4, the shim has an oxidation layer 80 over both it inner and outer surfaces. The layer 80 has a thickness in the range of 0.0002–0.0003 inch on each side and is formed by heat treating the shim in an air atmosphere at 2075° F. for 14 to 16 minutes. The shim is preferably made of a cobalt alloy such as L605.

Thus, a shim 50 is provided that prevent fretting between the fan blade root and its corresponding disk slot. Further, the shim 50 is slotted to engage tabs extending downward from the blade root which then hold the shim in place during the operation of the engine.

Various modifications and alterations of the above described rotor assembly will be apparent to those skilled in the art. Accordingly, the foregoing detailed description of the preferred embodiment of the invention should be considered exemplary in nature and not as limiting to the scope and spirit of the invention as set forth in the following claims.

What is claimed is:

1. A rotor assembly for a gas turbine engine, comprising:

a disk having along its periphery at least one dovetail groove;

a blade having an airfoil portion and a root portion, said root portion contoured to be received within said dovetail groove and having an inner surface that extends axially from a leading edge to a trailing edge, said inner surface having first and second tab members extending inward therefrom to define a gap between said inner surface and a base of said groove; and a compliant shim disposed in said gap and having a first slot for engaging said first tab and a second slot for engaging said second tab.

2. The assembly of claim 1 wherein said shim has a flat base and two spaced apart walls extending therefrom.

3. The assembly of claim 2 wherein each of said walls is curvilinear.

4. The assembly of claim 3 wherein said walls have first portions that curve away from each other, second portions that curve towards each other and third portions that curve away from each other.

5. The assembly of claim 1 further comprising a oxidation layer over at least a portion of said shim.

6. The assembly of claim 5 wherein the thickness of said oxidation layer is in the range 0.0002–0.0003 inch.

7. The assembly of claim 5 wherein said disk and blade are made of titanium and said shim is made of a cobalt alloy.

8. The assembly of claim 5 wherein said disk and blade are made of titanium alloy and said shim is made of cobalt alloy.

9. A compliant shim for use between a fan blade and a rotor disk comprising a base portion extending from a first end to a second end, said first and second ends each having a slot for engaging a corresponding tab extending from said blade and two curvilinear spaced apart walls extending outward from said base to define a space for receiving a root portion of said blade.

10. The compliant shim of claim 9 wherein said walls have first portions that curve away from each other, second portions that curve towards each other and third portions that curve away from each other.

11. The compliant shim of claim 10 further comprising a oxidation layer over said base portion and said walls.

12. The compliant shim of claim 11 wherein the thickness of said oxidation layer is in the range of 0.0002–0.0003 inch.

13. A rotor assembly for a gas turbine engine, comprising:

a disk having along its periphery at least one dovetail groove;

a blade having an airfoil portion and a root portion, said root portion contoured to be received within said dovetail groove and having an inner surface that extends axially from a leading edge to a trailing edge, said inner surface having first and second tab members extending inward therefrom to define a gap between said inner surface and a base of said groove;

a compliant shim disposed in said gap and having a first slot for engaging said first tab and a second slot for engaging said second tab; and an oxidation layer over at least a portion of said shim.

14. The assembly of claim 13 wherein said shim has a flat base and two spaced apart walls extending therefrom.

15. The assembly of claim 14 wherein each of said walls is curvilinear.

16. The assembly of claim 15 wherein said walls have first portions that curve away from each other, second portions that curve towards each other and third portions that curve away from each other.

17. The assembly of claim 13 wherein the thickness of said oxidation layer is in the range 0.0002–0.0003 inch.

18. The assembly of claim 13 wherein said disk and blades are made of tanium and said shim is made of a cobalt alloy.

19. The assembly of claim 13 wherein said disk and blade are made of titanium alloy and said shim is made of a cobalt alloy.

20. A compliant shim for use between a fan blade and a rotor disk comprising a base portion extending from a first end to a second end, said first and second ends each having a slot for engaging a corresponding tab extending from said blade and two curvilinear spaced apart walls extending outward from said base to define a space for receiving a root portion of said blade, said shim further comprising an oxidation layer over said base portion and said walls.

21. The compliant shim of claim 20 wherein said walls have first portions that curve away from each other, second portions that curve toward each other and third portions that curve away from each other.

22. The compliant shim of claim 20 wherein the thickness of said oxidation layer is in the range of 0.0002–0.0003 inch.

* * * * *